US005465701A

United States Patent [19]

Hunt

[11] Patent Number: 5,465,701

[45] Date of Patent: Nov. 14, 1995

[54] INTERNAL COMBUSTION FUEL CONTROL SYSTEM

[75] Inventor: Frank Hunt, Walled Lake, Mich.

[73] Assignee: Hitachi America, Ltd., Tarrytown, N.Y.

[21] Appl. No.: 172,749

[22] Filed: Dec. 27, 1993

[51] Int. Cl.[6] ..... F02M 23/00

[52] U.S. Cl. ..... 123/531; 123/179.15; 123/491

[58] Field of Search ..... 123/491, 179.14, 123/179.15, 179.18, 531, 549

[56] References Cited

U.S. PATENT DOCUMENTS

| | | | |
|---|---|---|---|
| 3,812,830 | 5/1974 | Traisnel | 123/491 |
| 4,187,821 | 2/1980 | Zebli | 123/179.18 |
| 4,216,757 | 8/1980 | Romann | 123/179.15 |
| 4,286,553 | 9/1981 | Baltz et al. | 123/179.14 |
| 4,705,004 | 11/1987 | Takahashi et al. | 123/491 |
| 4,825,834 | 5/1989 | Toshimitsu et al. | 123/491 |
| 5,148,788 | 9/1992 | Saikalis et al. | 123/339 |
| 5,150,673 | 9/1992 | Hoshiba et al. | 123/179.18 |
| 5,156,133 | 10/1992 | Sugimoto et al. | 123/531 |
| 5,218,943 | 6/1993 | Takeda et al. | 123/531 |
| 5,284,117 | 2/1994 | Akase | 123/491 |
| 5,331,937 | 7/1994 | Clarke | 123/491 |

OTHER PUBLICATIONS

Investigation of High Responses Fuel Injection Systems T. Yamauchi, T. Sasayama Hitachi America Ltd. U.S.A. pp. 48–54 Paper No. 90613 date unknown.

Development of Air–Assisted Injector System Kenichi Harada, Rio Shimizu, Kenji Kurita & Motoyasu Muramatsu Toyota Motor Corporation Paper No. 920294, date unknown.

Cold Start Performance of an Automotive Engine Using Prevaporized Gasline R. J. Boyle et al. The Engineering Society for Advancing Mobility Land Sea Air and Space Mar. 1, 1993.

*Primary Examiner*—Thomas N. Moulis
*Attorney, Agent, or Firm*—Gifford, Krass, Groh, Sprinkle, Patmore, Anderson & Citkowski

[57] ABSTRACT

A fuel control system is provided for an internal combustion engine having at least one combustion chamber, an intake air passageway, a multipoint fuel injector associated with each engine combustion chamber and a cold start fuel injector having a fuel outlet open to the intake air passageway. An air valve has an air inlet fluidly connected to the intake air passage and an air outlet fluidly connected to the cold start fuel injector. This air valve movable between an open position and a closed position where in the open position, air flow through the air valve is directed to the cold start fuel injector. During a cold start engine operating condition, air flow through the air valve and cold start fuel injector enhances fuel atomization of the fuel from the cold start fuel injector thereby reducing the desirable engine emissions, and particularly, hydrocarbon engine emissions.

16 Claims, 3 Drawing Sheets

INTERNAL COMBUSTION FUEL CONTROL SYSTEM

BACKGROUND OF THE INVENTION

Field of the Invention

The present invention relates to a fuel control system for reducing engine emissions and, more particularly, to such a system for reducing engine emissions during a cold engine starting condition.

SUMMARY OF THE PRESENT INVENTION

Most modem day internal combustion-engines of the type used in automotive vehicles utilize a multipoint fuel injector associated with each combustion chamber of the engine. These multipoint fuel injectors introduce fuel to the combustion chamber during all engine operating conditions, except a cold start engine operating condition.

In order to provide fuel to the engine during a cold start condition, a cold start fuel injector is often times provided in the air intake for the engine. The single cold start fuel injector injects sufficient fuel into the air intake passageway to provide fuel for all cylinders of the engine during the engine start up.

To insure engine starting during a cold engine condition, it has been the previous practice for the cold start fuel injector to inject sufficient fuel into the engine to achieve a rich air/fuel ratio typically in the range of 10:1 to 14:1. Even though such a rich air/fuel ratio is sufficient to ensure adequate starting of the engine during a cold starting condition, the overly rich air/fuel ratio produces a relatively high amount of undesirable engine emissions and, particularly, hydrocarbon emissions. Such high hydrocarbon emissions during engine start up are not only undesirable, but also fail to meet increasingly rigorous governmental regulations.

SUMMARY OF THE PRESENT INVENTION

The present invention provides a fuel control system specifically designed to achieve low hydrocarbon emissions from the engine during a cold engine start up.

In brief, the present invention comprises a three way air valve having an inlet fluidly connected to the engine air intake up stream from the throttle and a first air outlet fluidly connected to the cold start fuel injector. Moreover, the cold start fuel injector is positioned so that it delivers fuel to the engine down stream from the throttle.

The first air outlet from the three air valve is fluidly connected to the cold start fuel injector such that the air flow through the air valve and cold start fuel injector enhances the atomization of the fuel injected by the cold start fuel injector. Such atomization enables more complete combustion of the fuel by the internal combustion engine during a cold start engine operating Condition. Consequently, the air/fuel ratio during a cold start can be maintained at or just above stoichiometric, i.e. in the range of 14.64:1–16.0:1 thereby reducing hydrocarbon emissions and achieving a fast engine warm up.

The three way air valve also preferably includes a second air outlet which is fluidly connected to the multipoint fuel injectors. During preselected engine operating conditions, e.g. partial acceleration, cruise and idle, the air vane fluidly connects its inlet to the second outlet as providing air flow to the multipoint fuel injectors. Such air flow enhances fuel atomization by the multipoint injectors during these preselected engine operating conditions. Similarly, the air valve preferably provides air flow to the multipoint fuel injectors during an engine deceleration to prevent engine stalling.

If further fuel atomization is desired from the cold start injector, a fuel vaporizer may also be used in conjunction with the cold start fuel injector.

BRIEF DESCRIPTION OF THE DRAWING

A better understanding of the present invention will be had upon reference of the following detailed description, when read in conjunction with the accompany drawing, wherein like reference characters refer to like parts through out the several views, and in which.

DETAILED DESCRIPTION OF A PREFERRED EMBODIMENT OF THE PRESENT INVENTION

Figure 1:
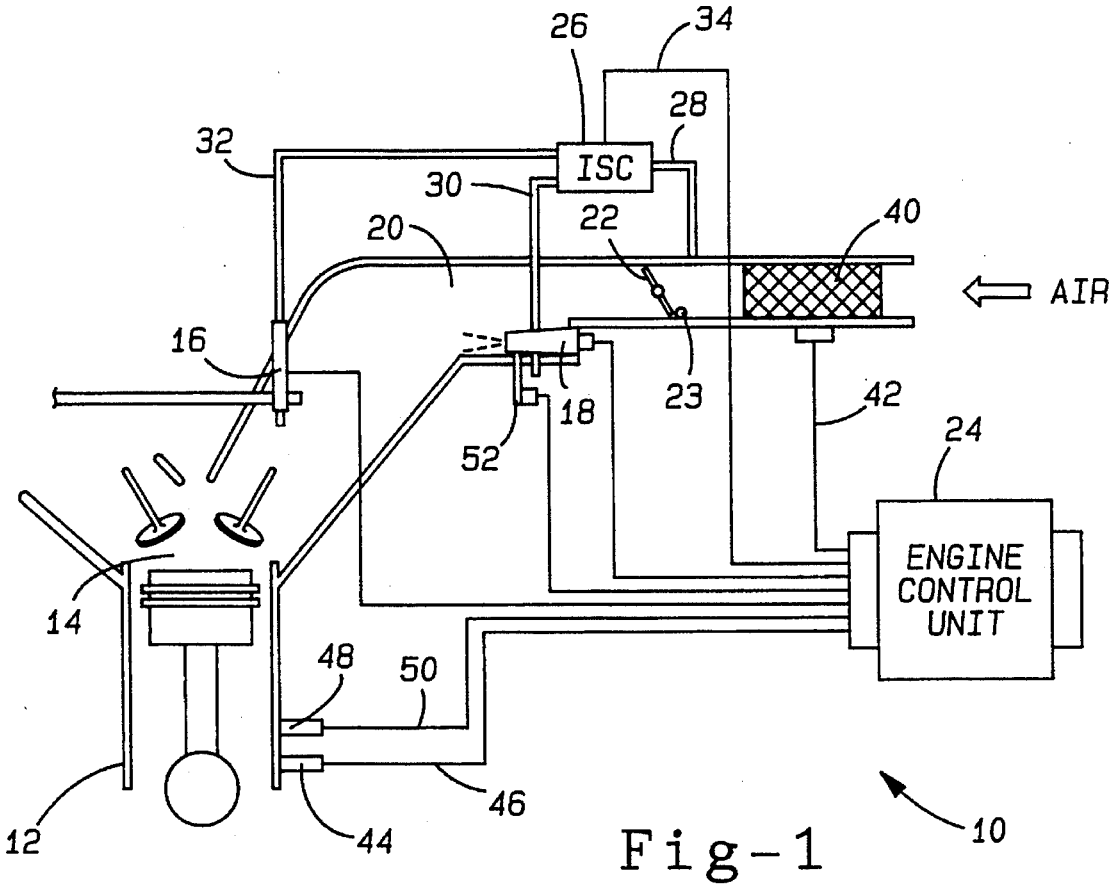
FIG. 1 is a diagrammatic view illustrating a preferred embodiment of the present invention.

With reference first to FIG. 1, a diagrammatic view of a preferred embodiment of the fuel control system 10 of the present invention is thereshown for use with an internal combustion engine 12. The engine 12 includes a plurality of combustion chambers 14 (only one illustrated) and a multipoint fuel injector 16 is associated with each combustion chamber 14. In the conventional fashion, the multipoint fuel injectors 14 supply fuel to the engine 12 during all engine operating conditions, except for a cold start engine operating condition.

In order to provide fuel to the engine during a cold start engine operating condition, a cold start fuel injector 18 is provided so that the outlet from the cold start injector 18 is open to an air intake passageway 20 for the internal combustion engine 12. Furthermore, as shown in FIG. 1, the outlet from the cold start injector 18 is positioned downstream from a throttle 22 for the engine 12. An engine control unit (ECU) 24 controls the operation of the cold start injector 18 and thus the amount of fuel introduced by the cold start injector 18 into the air intake passageway 20. The engine control unit 24 is preferably microprocessor based.

Still referring to FIG. 1, a three way air valve 26 (ISC) has an air inlet 28 fluidly connected to the air intake 20 upstream from the throttle 22. A first air outlet 30 from the valve 26 is fluidly connected to the cold start injector 18 while, similarly, a second air outlet from the valve 26 is fluidly connected to the multipoint injectors 16.

The engine control unit 24 controls the actuation of the air valve 26 by providing control signals to the valve 26 on control line 34. Thus, by appropriate signals from the engine control unit 24, the valve 26 fluidly connects inlet 28 to the first outlet 30, the second outlet 32, both outlets 30 and 32 as well as closing fluid communication between the outlet 28 and both outlets 30 and 32.

The engine control unit 24 also receives signals from the engine which are indicative of engine operating conditions. For example, a mass air flow sensor 40 is fluidly connected in series with the air intake 20 and provides an output signal on line 42 indicative of the mass air flow to the engine 12. Similarly, a revolutions per minute sensor 44 provides an output signal on line 46 to the engine control unit 24 indicative of the engine speed while a coolant temperature sensor 48 provides an output signal on line 50 to the engine control unit 24 indicative of the engine coolant temperature. A throttle position sensor 23, also provides a signal to the engine control unit indicative of the position of the throttle 22.

Figure 2:
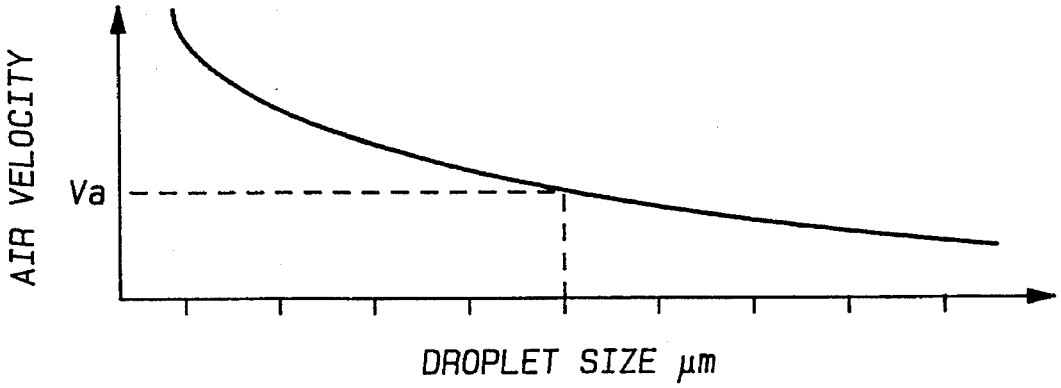
FIG. 2 is a graph illustrating fuel droplet size as a function of their velocity.

With reference now to FIGS. 1 and 2, a first outlet 30 from the air valve 26 is fluidly connected to the cold start fuel injector so that air flow through the vane 26 and outlet 30 increases the air velocity of the fuel injected into the air intake 20. As indicated in FIG. 2, increasing the air velocity of the fuel injected by the cold start injector 18 enhances the atomization of the fuel which, in turn, enables more complete combustion of the fuel. If even still vaporization of the fuel is desired, a vaporizer 52, such as an electric heater, controlled by the engine control unit: 24 can be used in conjunction with the cold start injector 18.

In operation, the engine control unit 24 utilizes the output from the coolant temperature sensor 48 to determine a cold engine start condition. During an engine cold start condition, the engine control unit 24 generates an output signal to the vane 26 so that the vane 26 fluidly connects its inlet 28 with both outlets 30 and 32. Thus, the air flow through the cold start injector 18 increases atomization of the fuel by increasing fuel velocity whereas the air flow through the multipoint injector 16 further enhance the atomization of the fuel as the fuel enters the combustion chamber the air flow through the valve 26 and outlet 30 to the cold start injector 18 may be directed at the fuel after injection into the air stream or, alternatively, the air flow may pass through the injector 18 with the fuel flow. In either event, atomization of the fuel is enhanced.

Preferably the engine control unit, by monitoring the signal from the mass air flow sensor 40 and controlling the amount of fuel introduced by the cold start injector 18 during a cold start, maintains the air/fuel ratio at or just above stoichiometric. In doing so, hydrocarbon emissions from the engine are greatly reduced during a cold start and, simultaneously, a stoichiometric or slightly lean air/fuel ratio provides a more rapid engine warm up than the previously known rich air fuel ratios used with a cold start fuel injector.

The cold start fuel injector 18 introduces fuel into the intake passageway 20 only during a cold start engine operating condition. Conversely, the multipoint fuel injectors 16 provides fuel to the engine during all other operating conditions.

The three way air vane 26,-however, provides air flow to the multipoint injector 16 during preselected engine operating conditions. These preselected engine operating conditions include engine cruising, partial acceleration and idle. In addition, during an idle engine operation condition, the air valve 26 fluidly connects its inlet 22 with both outlets 30 and 32 to provide sufficient air to the engine even though no fuel is provided by the cold start injector 18 except during a cold start engine operating condition.

Figure 3A:
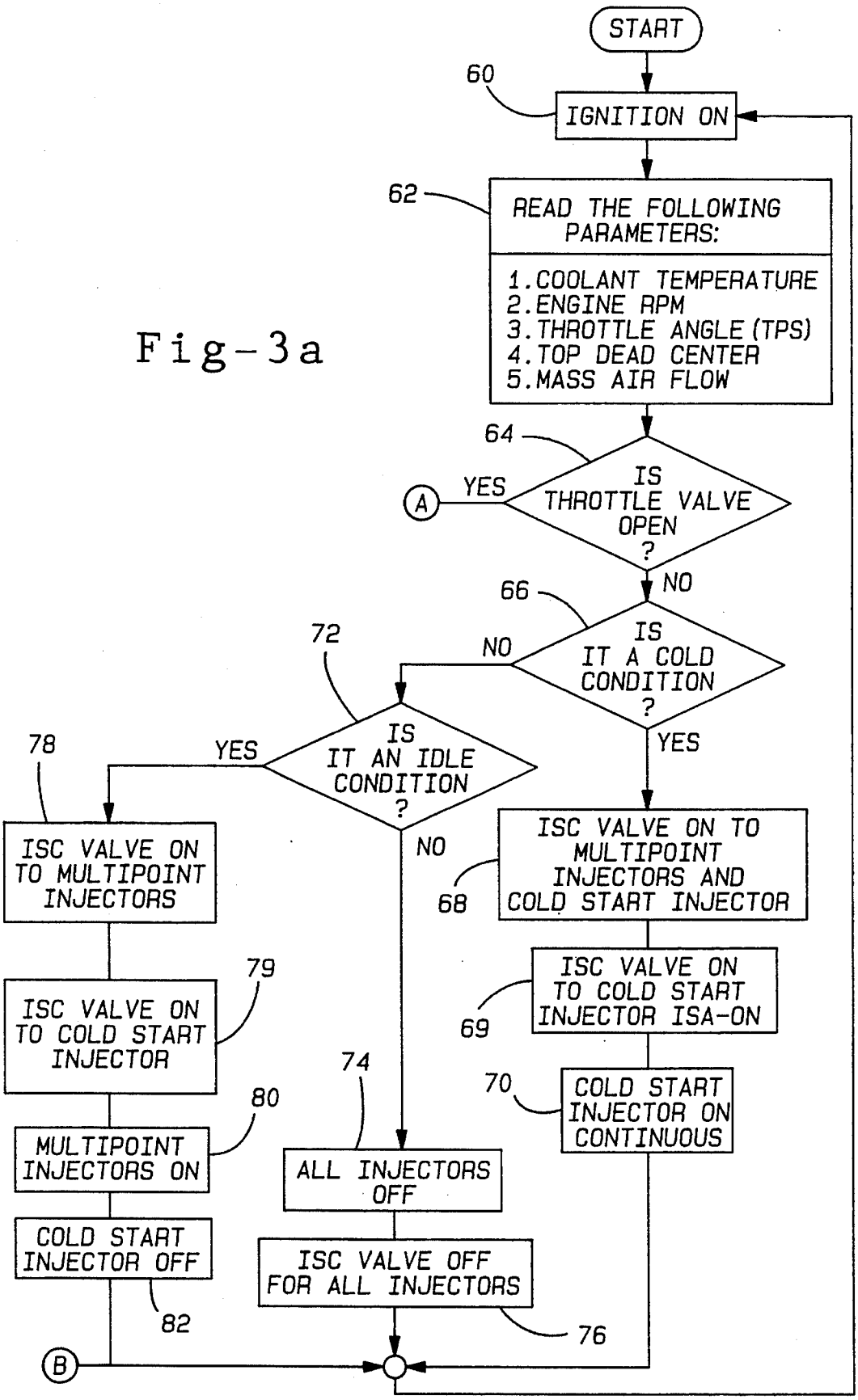
FIGS. 3*a* and 3*b* are flow charts illustrating the operation of the preferred embodiment of the present invention.
Figure 3B:
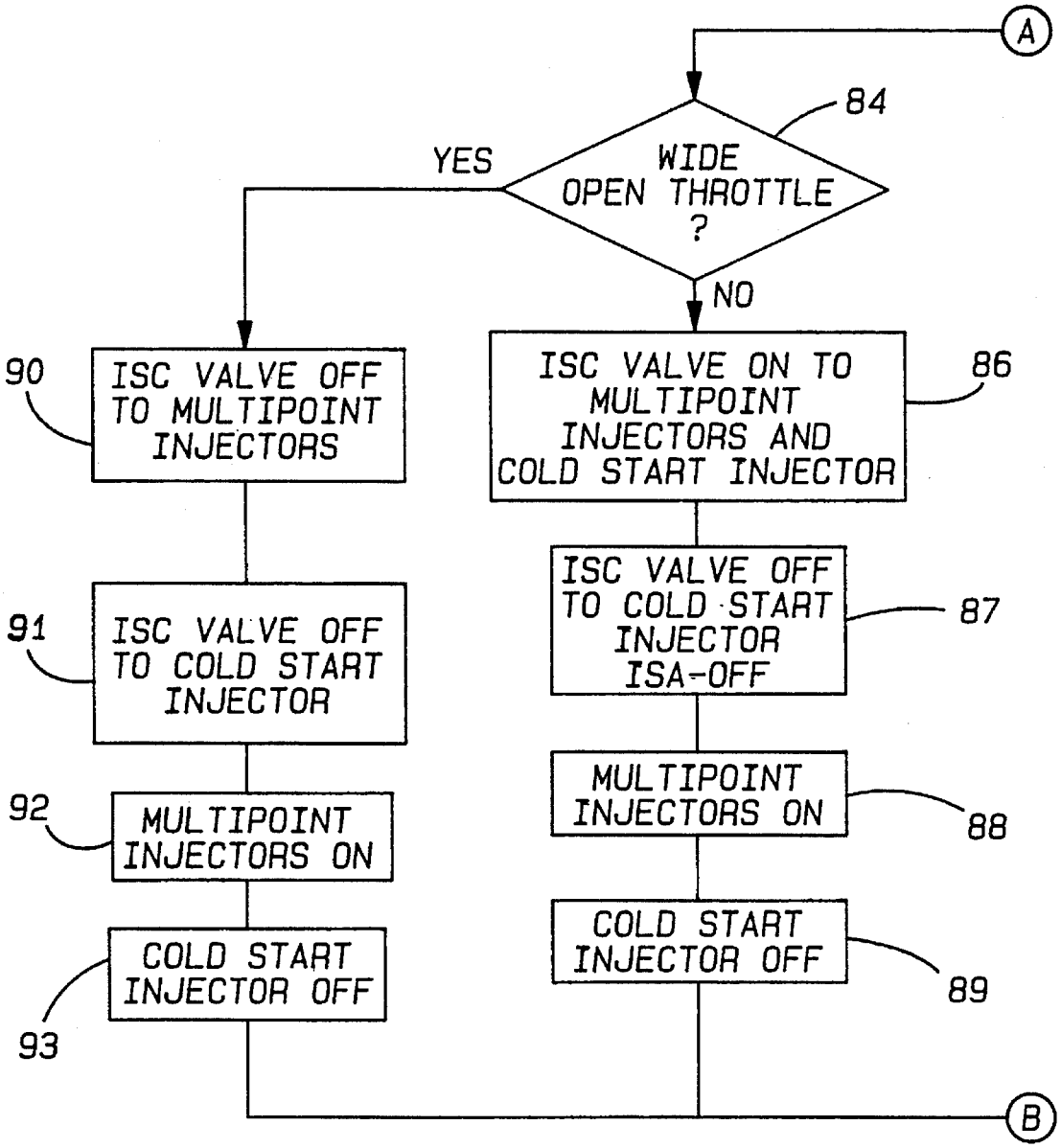

With reference now to FIGS. 3*a* and 3*b*, a flow chart for controlling the operation of the microprocessor in the engine control unit 24 is thereshown. After the ignition is activated at step 60, step 60 branches to step 62 where the engine control unit 24 reads the output signals from the temperature sensor 48, the engine rpm sensor 44, the throttle and position sensor 49 the output signal from the mass air flow sensor 40. Step 62 then branches to step 64.

At step 64, the program determines if the throttle is open from the throttle position sensor 49. If the throttle is closed, indicative of an idle condition, step 64 branches to step 66 which determines, from the coolant temperature sensor 48, if it is a cold start engine condition. If so, step 66 branches to step 68 in which the engine control unit 24 actuates the valve 26 to fluidly connect its inlet 22 to the multipoint injectors via outlet 32 and then to step 69 where the air valve 26 connects the air inlet 22 to their cold start injector via the outlet 30. Step 69 then branches to step 70 in which the engine control unit 24 activates the cold start injector 18 to provide continuous fuel to the engine. Step 72 then branches back to step 60 and the above process is repeated.

Assuming that the throttle is closed but the engine is not in a cold start condition, step 66 instead branches to step 72. Step 70 then determines if an idle condition is present. If an idle condition is not present, indicative of a deceleration condition, step 72 branches to step 74 which shuts off the fuel supply to all fuel injectors 16 and 18. Step 74 then branches to step 76 in which the engine control unit activates the valve 26 to terminate the air flow to all fuel injectors 16 and 18 and ! then branches to step 60 where the above process is repeated.

Conversely, if an idle engine operating condition is present, step 72 instead branches to step 78 in which the engine control unit 24 activates the valve 26 to provide air flow to the multipoint fuel injectors 16. Step 78 then branches to step 79 which activates the valve 26 to supply air to the cold start injector 18 and then step 80 which activates the fuel supply to the multipoint injectors 18. Step 80 then branches to step 82 which deactivates the fuel flow to the cold start injector 18.

Assuming, however, that the throttle is open, step 64 instead branches to step 84 (FIG. 3*b*) to determine if a wide open throttle condition is present. If not, indicative of or partial acceleration or cruise condition, step 84 branches to step 86 which actuates the air valve 26 to provide air to both the multipoint injector 16 and cold start injector and then to step 87 which terminates air flow to the cold start injector. Step 87 then branches to step 88 which provides fuel to the multipoint injector 16 and at step 89 shuts off the fuel flow through the cold start injector 18. Step 89 then reiterates back to step 60 and the above process is repeated.

Assuming that a wide open throttle position is present, step 84 branches to step 90 where the engine control unit 24 activates the air valve 26 to shut off the air flow to the multipoint injectors 16 and then to step 91 where the valve 26 shuts off the air supply to the cold start injector 13 cold start injector 18. In doing so, a rich air fuel ratio supply to the engine for maximum engine power. Step 90 then branches to step 92 which activates the fuel supply to the multi point injector 18 and at step 93 terminates the fuel supply to the cold start injector 18. Step 92 then branches back to step 60.

From the foregoing, it can be seen that the present invention provides a fuel control system which is particularly useful in reducing engine emissions, in particularly hydrocarbon emissions, and a cold start engine condition.

Having described my invention, however, many modifications thereto will become apparent to those skilled in the art to which it pertains without deviation from the spirit of the invention as defined by the scope of the appended claims.

I claim:

1. For use with an internal combustion engine having at least one combustion chamber, an intake air passage means, a multipoint fuel injector associated with each engine combustion chamber and a cold start fuel injector having a fuel outlet open to the intake air passage means, said cold start fuel injector providing fuel to each combustion chamber during a cold start engine operating condition, a fuel control system comprising:

air valve means having an air inlet fluidly connected to said intake air passage means and an air outlet fluidly connected to the cold start fuel injector, said air valve means being movable between an open position and a closed position, wherein in said open position air flow through said cold start fuel injector enhances atomization of fuel injected from said cold start fuel injector, means for detecting a cold engine operating condition and for generating a cold start output signal representative thereof, means responsive to said cold start output signal for selectively actuating said air valve means to said open position, a fuel vaporizer for vaporizing fuel from said cold start fuel injector, wherein said fuel vaporizer comprises an electric heater, wherein the cold start fuel injection supplies all of the fuel to the engine during a cold start engine condition.

2. The invention as defined in claim 1 and including a throttle in said air intake passageway, said air valve air inlet being fluidly connected upstream from said throttle and said cold start fuel injector being fluidly connected to said air intake passageway downstream from said throttle.

3. The invention as defined in claim 1 wherein said air valve means comprises a second outlet fluidly connected to each multipoint fuel injectors, means responsive to preselected engine operating conditions for selectively actuating said air valve means to fluidly connect said air valve inlet to said second outlet to thereby enhance fuel atomization of fuel injected by said multipoint fuel injectors.

4. The invention as defined in claim 3 wherein said preselected engine operating conditions comprises an idle engine operating condition.

5. The invention as defined in claim 3 wherein said preselected engine operating condition comprises a cruising engine operating condition.

6. The invention as defined in claim 3 wherein said preselected engine operating conditions comprises a partial acceleration engine operating condition.

7. The invention as defined in claim 1 and comprising means for detecting the position of the throttle and means for supplying fuel to the cold start fuel injector only during a throttle closed position and said cold start output signal.

8. The invention as defined in claim 1 wherein said detecting means comprises means for detecting a coolant temperature of said engine.

9. The invention as defined in claim 1 wherein said detecting means comprises a microprocessor.

10. The invention as defined in claim 1 and comprising means for terminating air flow through said air valve means during preselected engine operating conditions.

11. The invention as defined in claim 10 wherein said preselected engine operating conditions comprises an engine acceleration operating condition.

12. The invention as defined in claim 10 wherein said preselected engine operating conditions comprises an engine deceleration operating condition.

13. The invention as defined in claim 1 and comprising a fuel vaporizer for vaporizing fuel from said cold start fuel injector.

14. The invention as defined in claim 13 wherein said fuel vaporizer comprises an electric heater.

15. The invention as defined in claim 3 wherein said valve means comprises a three way valve.

16. For use with an internal combustion engine having at least one combustion chamber, an intake air passage means, a multipoint fuel injector associated with each engine combustion chamber and a cold start fuel injector having a fuel outlet open to the intake air passage means, said cold start fuel injector providing fuel to each combustion chamber during a cold start engine operating condition, a fuel control system comprising:

air valve means having an air inlet fluidly connected to said intake air passage means and an air outlet fluidly connected to the cold start fuel injector, said air vane means being movable between an open position and a closed position, wherein in said open position air flow through said cold start fuel injector enhances atomization of fuel injected from said cold start fuel injector, means for detecting a cold engine operating condition and for generating a cold start output signal representative thereof, means responsive to said cold start output signal for selectively actuating said air valve means to said open position, wherein said air valve means comprises a second outlet fluidly connected to each multipoint fuel injectors, means responsive to preselected engine operating conditions for selectively actuating said air valve means to fluidly connect said air vane inlet to said second outlet to thereby enhance fuel atomization of fuel injected by said multipoint fuel injectors, and wherein said valve means comprises a three way valve.

* * * * *

UNITED STATES PATENT AND TRADEMARK OFFICE

CERTIFICATE OF CORRECTION

PATENT NO. : 5,465,701

DATED : November 14, 1995

INVENTOR(S) : Frank Hunt

It is certified that error appears in the above-indentified patent and that said Letters Patent is hereby corrected as shown below:

Column 1, line 15, delete "modem" and insert --modern--;

line 57, delete "Condition" and insert --condition--;

line 65, delete "vane" and insert --valve--.

UNITED STATES PATENT AND TRADEMARK OFFICE

CERTIFICATE OF CORRECTION

PATENT NO. : 5,465,701

DATED : November 14, 1995

INVENTOR(S) : Frank Hunt

It is certified that error appears in the above-indentified patent and that said Letters Patent is hereby corrected as shown below:

Column 3, line 9, delete "vane" and insert --valve--;

line 16, delete "unit:" and insert --unit--;

line 22, delete "vane" and insert --valve-- (both occurrences);

line 47, delete "vane" and insert --valve--;

line 47, delete "-however" and insert --however--;

Column 4, line 18, delete paragraph indentation;

line 19, delete "and !" and insert --and--;

UNITED STATES PATENT AND TRADEMARK OFFICE

CERTIFICATE OF CORRECTION

PATENT NO. : 5,465,701

DATED : November 14, 1995

INVENTOR(S) : Frank Hunt

It is certified that error appears in the above-indentified patent and that said Letters Patent is hereby corrected as shown below:

Column 6, claim 16, line 30, delete "vane" and insert --valve--.

Column 6, claim 16, line 45, delete "vane" and insert --valve--.

Signed and Sealed this

Sixteenth Day of April, 1996

Bruce Lehman

*Attest:*

BRUCE LEHMAN

*Attesting Officer*

*Commissioner of Patents and Trademarks*